US011364978B2

(12) United States Patent
Reid

(10) Patent No.: US 11,364,978 B2
(45) Date of Patent: Jun. 21, 2022

(54) UNDERWATER SHIP ATTACHMENT USED TO DIVERT AIR, BUBBLES, DEBRIS, ICE, AND PRESSURE FLUCTUATIONS

(71) Applicant: Jordan Wesley Reid, Juneau, AK (US)

(72) Inventor: Jordan Wesley Reid, Juneau, AK (US)

( * ) Notice: Subject to any disclaimer, the term of this patent is extended or adjusted under 35 U.S.C. 154(b) by 0 days.

(21) Appl. No.: 16/846,386

(22) Filed: Apr. 12, 2020

(65) Prior Publication Data

US 2021/0316826 A1 Oct. 14, 2021

(51) Int. Cl.
*B63B 59/00* (2006.01)
*B63B 3/38* (2006.01)

(52) U.S. Cl.
CPC ..... *B63B 59/00* (2013.01); *B63B 3/38* (2013.01)

(58) Field of Classification Search
CPC ..... B63B 59/00; B63B 3/38; B63B 1/00
USPC ..... 114/63, 142
See application file for complete search history.

(56) References Cited

U.S. PATENT DOCUMENTS 6,416,371 B1 * 7/2002 Johnson ..... B63B 43/18 114/219

FOREIGN PATENT DOCUMENTS

| | | | | |
|---|---|---|---|---|
| JP | 2009248831 A | * | 10/2009 | |
| JP | 2009248831 A | | 10/2009 | |
| KR | 101471229 B1 | * | 12/2014 | |
| KR | 101471229 B1 | | 12/2014 | |
| WO | WO-2009077778 A1 | * | 6/2009 | ..... F03B 17/063 |
| WO | WO 2009077778 A1 | | 6/2009 | |

OTHER PUBLICATIONS

Transducer bubble diverter http://fishwrecked.com/forum/transducer-bubble-diverter retrieved Aug. 27, 2021, available on the forum as of Sep. 24, 2018 (Year: 2018).*
Transducer bubble diverter http://fishwrecked.com/forum/transducer-bubble-diverter retrieved Apr. 12, 2020.

* cited by examiner

*Primary Examiner* — Anthony D Wiest
(74) *Attorney, Agent, or Firm* — Walker Griffin Weitzel; Alloy Patent Law

(57) ABSTRACT

An objective of the present invention is to provide an underwater ship attachment that is used to divert air, debris, and pressure fluctuations. More specifically, the present invention discloses an anti-cavitation device (such as a diverter device) for flat-bottom boats. The air diverter has been developed to regain, enhance, and protect the operational function of propulsive and steering equipment among displacement and semi displacement hulls. As with protect items such as bottom mounted depth sounder transducers, intakes for engine or general cooling, sea chests, keel coolers, zincs, and all other underwater mounted items susceptible to air ingestion, air disturbance malfunction or debris impact.

6 Claims, 5 Drawing Sheets

UNDERWATER SHIP ATTACHMENT USED TO DIVERT AIR, BUBBLES, DEBRIS, ICE, AND PRESSURE FLUCTUATIONS

FIELD OF THE INVENTION

The present application generally relates to a shipping equipment, and more particularly to an underwater ship attachment that is used to divert air, bubbles, debris, ice, and pressure fluctuations.

BACKGROUND

In general, the present invention is an anti-cavitation device for flat-bottom boats. This type of boat is particularly susceptible to drawing air in at the bow and not shedding the bubbles to the sides as a conventional boat hull would. The bubbles travel straight back and eventually encounter the propeller, leading to inefficiency and undue wear and tear. There is no known technology thus far which specifically targets the large shipping industries both inland and ocean going to combat the detrimental causes of air, debris, and ice upon propeller efficiency and damage. As tests have been conducted, the propellers on large ships or boats with any air lubrication system whatsoever have been losing a known 1-3% efficiency due to bubble ingestion.

In light of the above-mentioned background, there is a need for a technical solution that solves the above-mentioned problems and provides a seamless mechanism for an anti-cavitation device for flat-bottom boats. This device causes bubbles trapped at the hull bottom surface to be diverted outward and around the propellers and running gear.

SUMMARY

It will be understood that this disclosure is not limited to the particular systems and apparatus described herein, as there can be multiple possible embodiments of the present disclosure which are not expressly illustrated in the present disclosure. It is also to be understood that the terminology used in the description is for the purpose of describing the particular versions or embodiments only and is not intended to limit the scope of the present disclosure.

An objective of the present invention is to provide an underwater ship attachment that is used to divert air, debris, and pressure fluctuations. More specifically, the present invention discloses an anti-cavitation device (such as a diverter device) for flat-bottom boats. This device causes bubbles trapped at the hull bottom surface to be diverted outward and around the propellers and running gear. There is no known technology thus far which specifically targets large shipping industries both inland and ocean going to combat the detrimental causes of air, debris, and ice upon propeller efficiency and damage. However, the diverters presented herein may be used in various industries such as Open Ocean Shipping Industry and Inland River Towboat Industry.

Open Ocean Shipping Industry: Installing the diverters in front of a suction zone of a propeller on a large ocean-going ship which is installed with an ALS (air lubrication system). This may remove all efficiency hindering air of any kind generated from entering the propeller. As tests have been conducted, the propeller on the large ship with any air lubrication system whatsoever has been losing a known 1-2% efficiency due to bubble ingestion. The diverters presented in herein will help minimize such loss of efficiency.

Inland River Towboat Industry: Due to the shape of a tow or push, and the known semi-flat bottom of the towboats themselves, it is sheer nature for air to pass tightly along the bottom of the vessel and directly into the nozzles or open wheels of the vessel. By installing the diverters on either side of the keel or skeg in front of a towboat propeller gives various advantages. For example, it diverts air formed from the poorly shaped bows and sterns of the barges being pushed, along with the air formed from the tug when it is at free running speed. Any drift, debris, or ice floating down river which is trapped and pulled under the front of the barges or the tug may be caught before the propellers and diverted around in a safer and much less expensive area. The pressure fluctuations caused by the square geometry of the tows creates a mixed flow disturbance that enters the propellers. This alone can cause the propellers to cavitate during certain pushes even at speed. The diverters help dampen this by creating a natural barrier which catches these tight hull clinging surges of water, dissipating and diverting out around the wheels.

The multipurpose air diverters have been developed to regain, enhance, and protect the operational function of propulsive and steering equipment among displacement and semi displacement hulls. As with protect items such as bottom mounted depth sounder transducers, intakes for engine or general cooling, sea chests, keel coolers, zincs, and all other underwater mounted items susceptible to air ingestion, air disturbance malfunction or debris impact. The shape of the diverter resembles that of an upside-down airplane wings, at a swept 45-degree angle. The diverter is 20.5" in length, with a front face which is angled at 45 degrees with respect to AFT section of the ship to create a depth of water cleaned that is related to the height of front face. In an embodiment, the front face height is 3.5", which results in a depth of water cleaned of approximately 2.5". In an embodiment, the front face height is 4.5", which results in a depth of water cleaned of approximately 3.2". In an embodiment, the front face height is 5.5", which results in a depth of water cleaned of approximately 3.9".

These and other features and advantages of the present invention will become apparent from the detailed description below, in light of the accompanying drawings.

BRIEF DESCRIPTION OF ACCOMPANYING DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of various examples. It is expressly understood, however, that the drawings are for the purpose of illustration and description only and are not intended as a definition of the limits of the invention. Embodiments of this invention will now be described by way of example in association with the accompanying drawings in which:

Figure 1:
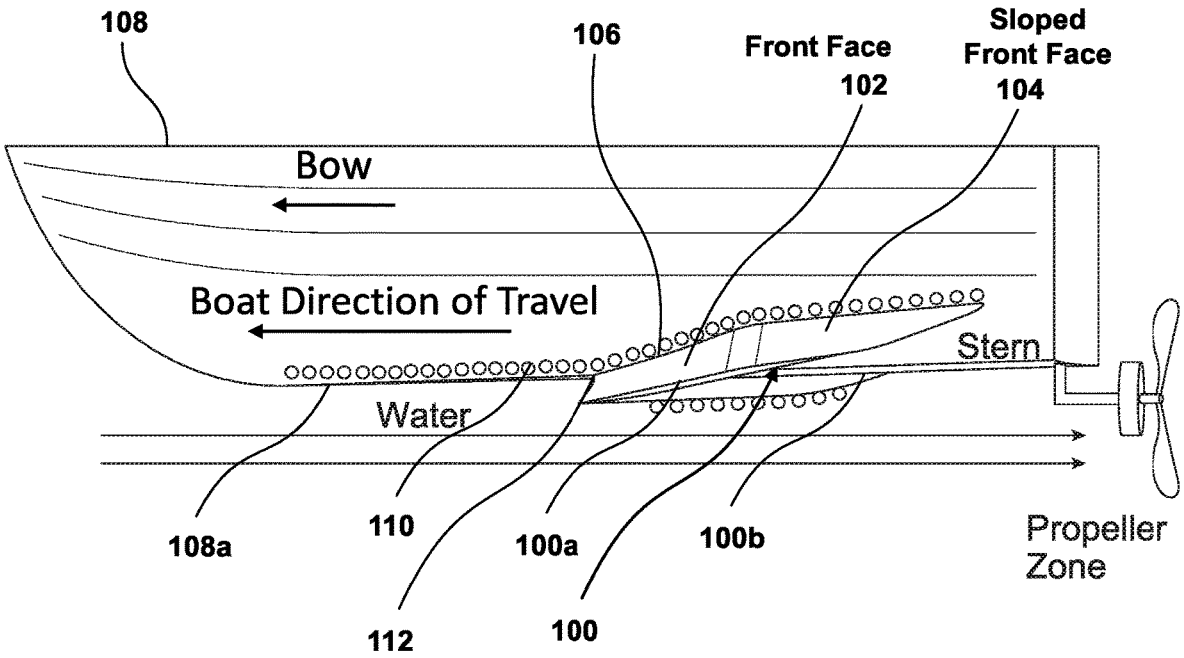
FIG. 1 is a diagram that illustrates a diverter set attached to a flat bottom boat, according to an exemplary embodiment of the present invention.

Further areas of applicability of the present invention will become apparent from the detailed description provided hereinafter. It should be further understood that the detailed description of exemplary embodiments is intended for illustration purposes only and is, therefore, not intended to necessarily limit the scope of the invention.

As used in the specification and claims, the singular forms "a", "an" and "the" may also include plural references. For example, the term "an article" may include a plurality of articles. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of components, which constitutes an underwater ship attachment that is used to divert hazards to the propeller such as debris, bubbles, air, solid objects, and pressure fluctuations. More specifically, the present invention discloses a diverter device for flat-bottom boat(s) or ship(s). The device is designed to capture the top layer of water and any hazards to the propeller contained therein in a diversion channel that will continuously flow outward into a path that is clear of the propeller. As the top layer is ejected outward, the next, deeper and cleaner layer will flow below the diversion channel, then flow upward and behind the diverter to replace the ejected layer of water and hazards with clean water.

References to "one embodiment", "an embodiment", "another embodiment", "yet another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

The words "comprising", "having", "containing", and "including", and other forms thereof, are intended to be equivalent in meaning and be open ended in that an item or items following any one of these words is not meant to be an exhaustive listing of such item or items or meant to be limited to only the listed item or items.

Unless stated otherwise, terms such as "first" and "second" are used to arbitrarily distinguish between the elements or entities. Thus, these terms are not necessarily intended to indicate temporal or other prioritization of such elements or priorities. While various exemplary embodiments of the disclosed systems and apparatuses have been described below, it should be understood that they have been presented for purposes of example only, and not limitations. It is not exhaustive and does not limit the present invention to the precise form disclosed. Modifications and variations are possible in light of the below teachings or may be acquired from practicing of the present invention, without departing from the breadth or scope.

The diverter device of the present invention will now be described with reference to the accompanying drawings, which should be regarded as merely illustrative without restricting the scope and ambit of the present invention. Embodiments of the present invention will now be described with reference to FIGS. 1-5.

FIG. 1 is a diagram that illustrates a diverter set 100 attached to a flat bottom boat 108, according to an exemplary embodiment of the present invention. The diverter 100 is bubble and debris diverter device for flat-bottom boats. The diverter 100 includes a plurality of portions such as a left-side diverter portion 100*a* and a right-side diverter portion 100*b*. The left-side diverter portion 100*a* and the right-side diverter portion 100*b* are directly attached (welded) to a bottom surface 108*a* from the bottom of the boat 108. The left and right side diverters are attached in a swept configuration, such that outboard portions of the diverters are swept toward the stern. In an embodiment, the diverters are swept toward the stern at a 45 degree angle. The left-side diverter portion 100*a* and the right-side diverter portion 100*b* are positioned on the bottom surface 108*a*, and welded to the bottom surface 108*a* all around every edge as shown. Each diverter portion (i.e., the left-side diverter portion 100*a* or the right-side diverter portion 100*b*) includes a plurality of portions such as a first portion 102 (which is a front face) and a second portion 104 (which is a sloped front face). The standard width and length of the first portion 102 is dependent on each application but ranges from 20" in length to 90" in length. The second portion 104 is a 3.5"-5.5" plate. The height of the second portion 104 is 2.5"-3.9". The first and second portions 102 and 104 are ¼-½-inch-thick steel or aluminum plates depending on a hull material of the boat. The first and second portions 102 and 104 (of both diverter portions) are mated to the bottom surface 108*a* of the flat bottom boat 108. When the boat 108 is travelling in its direction (as shown), bubbles, debris, or ice hit a front tip or point 112 of the diverter 100 and split at joint between two diverter portions (i.e., the left-side diverter portion 100*a* and the right-side diverter portion 100*b*) of the diverter 100. The bubbles, debris, or ice will be forced outward along the edge (as shown by 110) of each diverter portion and get diverted away from the propeller of the boat 108. Thus, only clean water may encounter the propeller of the boat 108.

Figure 2:
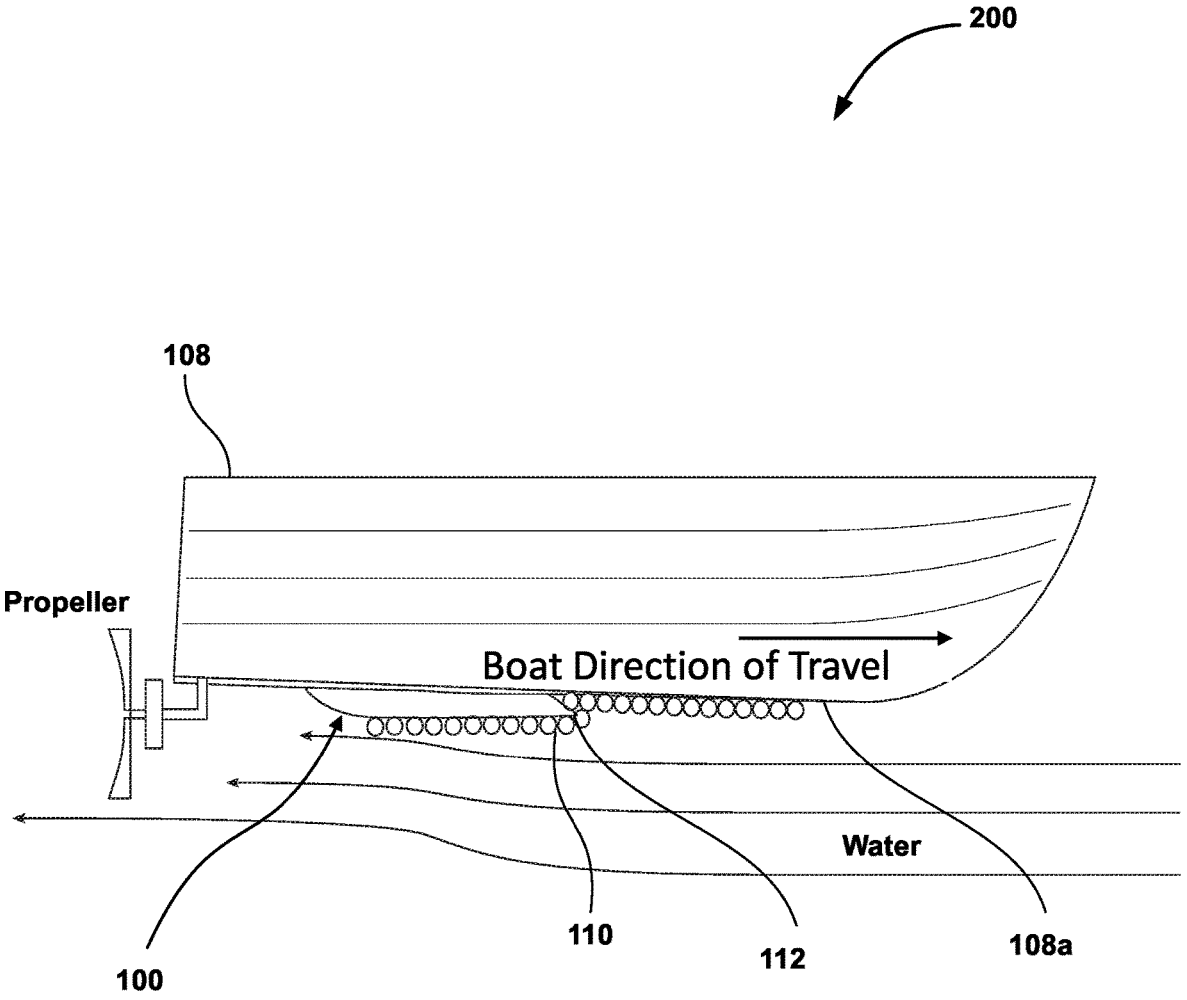
FIG. 2 is a diagram that illustrates a side view of the flat bottom boat with the diverter, according to an exemplary embodiment of the present invention.
Figure 3:
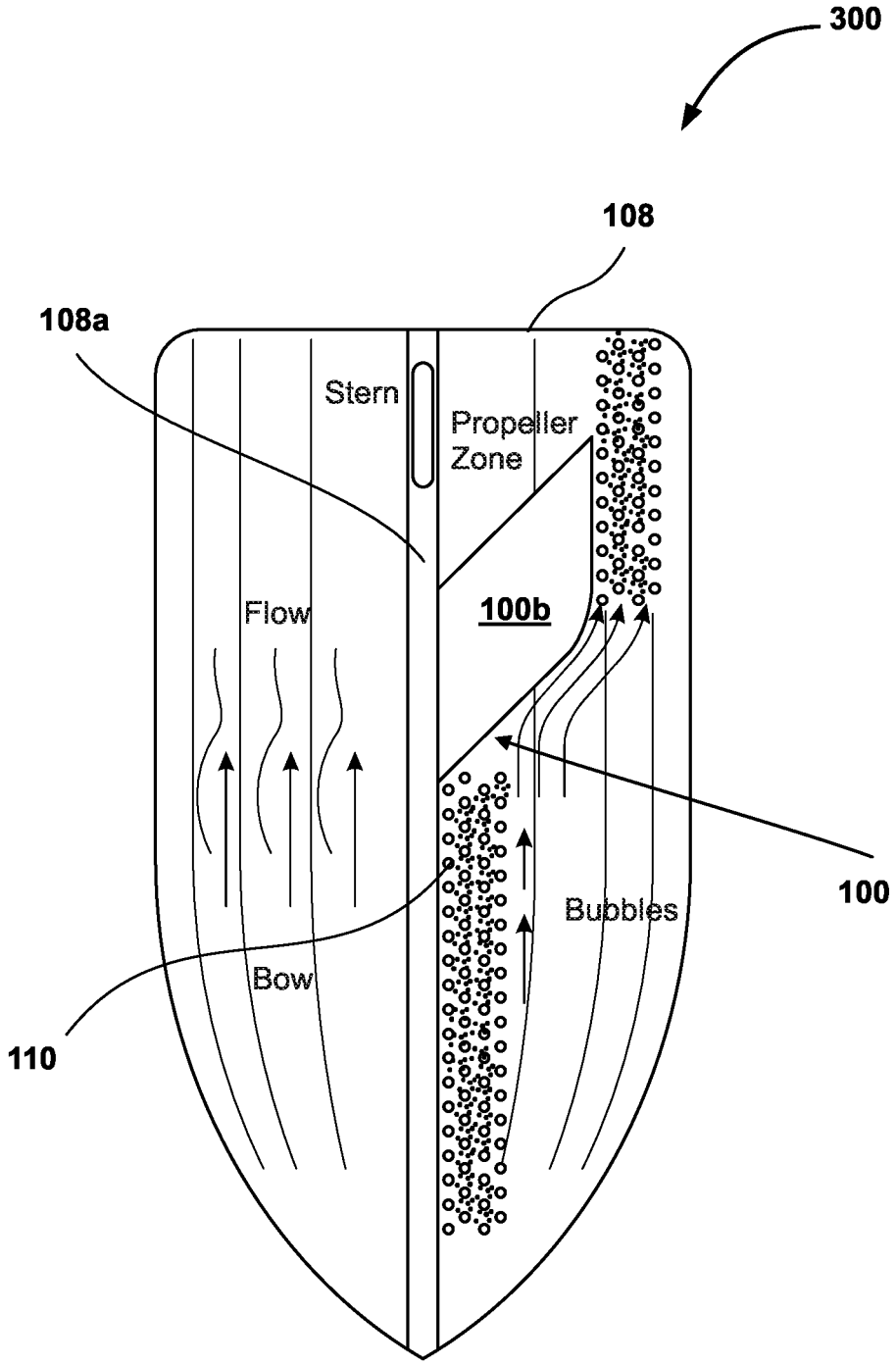
FIG. 3 is a diagram that illustrates a bottom view of the diverter attached to the flat bottom boat, according to an exemplary embodiment of the present invention.

FIG. 2 is a diagram 200 that illustrates a side view of the flat bottom boat 108 with the diverter 100, according to an exemplary embodiment of the present invention. FIG. 3 is a diagram 300 that illustrates a bottom view of the flat bottom boat 108 including the diverter 100, according to an exemplary embodiment of the present invention. In FIG. 3, for the purpose of simple illustration, only one diverter portion 100*b* of the diverter 100 has been shown but should not be construed as limiting to the scope of the present invention. The diverter 100 has an open area (i.e., a space in front of the tip or point 112) at the front side so that the bubbles 110 are caught, urged upward toward the hull, where they are trapped between the front face, due to the sloped front surface, and evacuated outward.

In an embodiment, the diverter portions (100*a* and 100*b* as shown in FIG. 1) are mated or welded to the bottom surface 108*a* of the flat bottom boat 108. In an embodiment, diverter portions are mated or welded such that they are at an acute angle to each other. The preferred angle of 45-degrees between the diverter portions causes the oncoming bubbles 110 to split along the two diverter portions. The bubbles 110 travel outward along the edge of each diverter portion and are diverted away from the propeller of the boat 108. Thus, the bubbles 110 do not encounter the propeller, and only clean water may encounter the propeller of the boat 108. The multipurpose diverter 100 has been developed to regain, enhance, and protect the operational function of propulsive and steering equipment among displacement and semi displacement hulls.

The length of the sloped front face portion 104 may be changed if the bubbles, air, debris, or ice conditions require a deeper section of water to be cleaned or diverted. When a length is added to its face, it creates a deeper section moving through the water.

Figure 4:
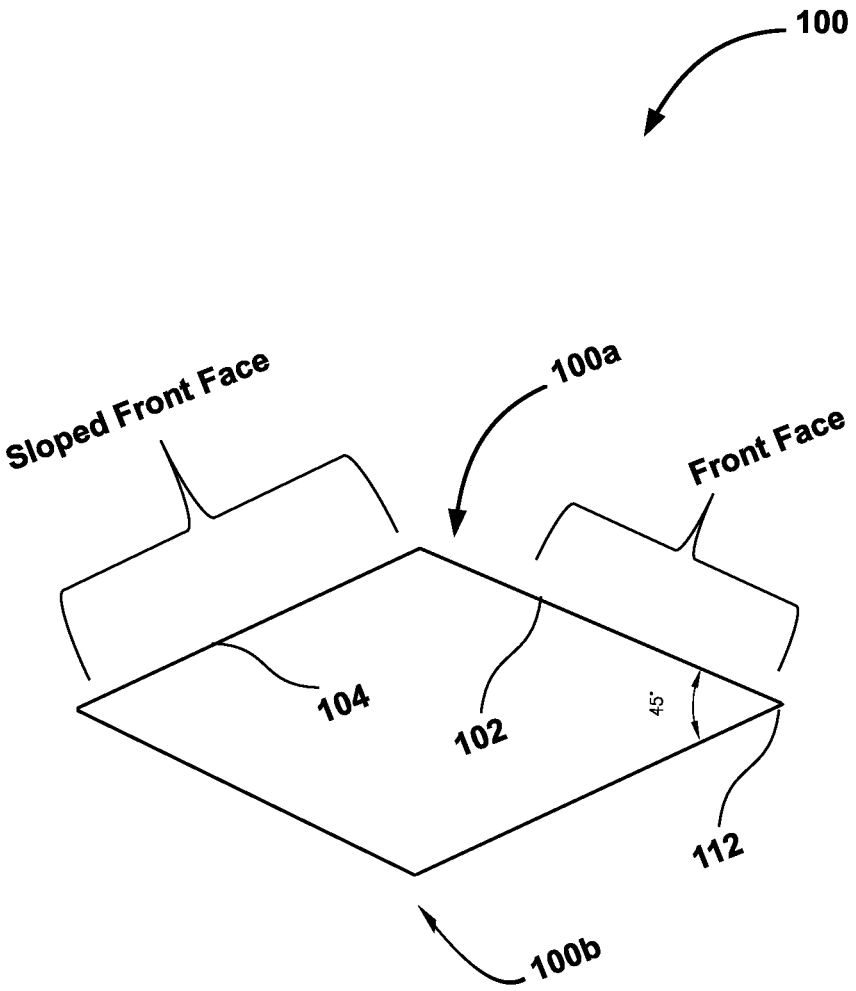
FIG. 4 is a diagram that illustrates a geometry of the diverter, according to an exemplary embodiment of the present invention.

FIG. 4 is a diagram that illustrates the geometry of the diverter 100, according to an exemplary embodiment of the present invention. The diverter 100 includes the left-side diverter portion 100*a* and the right-side diverter portion 100*b*. The left-side diverter portion 100*a* and the right-side diverter portion 100*b* are directly attached (welded) at 45-degrees to the bottom surface 108*a* from the bottom of the boat 108. The left-side diverter portion 100*a* and the right-side diverter portion 100*b* are positioned on the bottom surface 108*a* such that they are at 45-degrees to each other and then they are welded to the bottom surface 108*a* all around every edge as shown. Each diverter portion (i.e., the left-side diverter portion 100*a* or the right-side diverter portion 100*b*) includes the first portion 102 (which is the front face) and the second portion 104 (which is the sloped front face) that are attached or welded together at an angle greater than 90-degrees, for example, at 135-degrees.

In operation, the bubbles, debris, or ice hit the front tip or point 112 of the diverter 100 and split at an acute angle along the two diverter portions (i.e., the left-side diverter portion 100*a* and the right-side diverter portion 100*b*) of the diverter 100. The bubbles, debris, or ice travel outboard along the edge (as shown in FIGS. 1-3) of each diverter portion and get diverted away from the propeller of the boat 108. Thus, only clean water may encounter the propeller of the boat 108.

Figure 5:
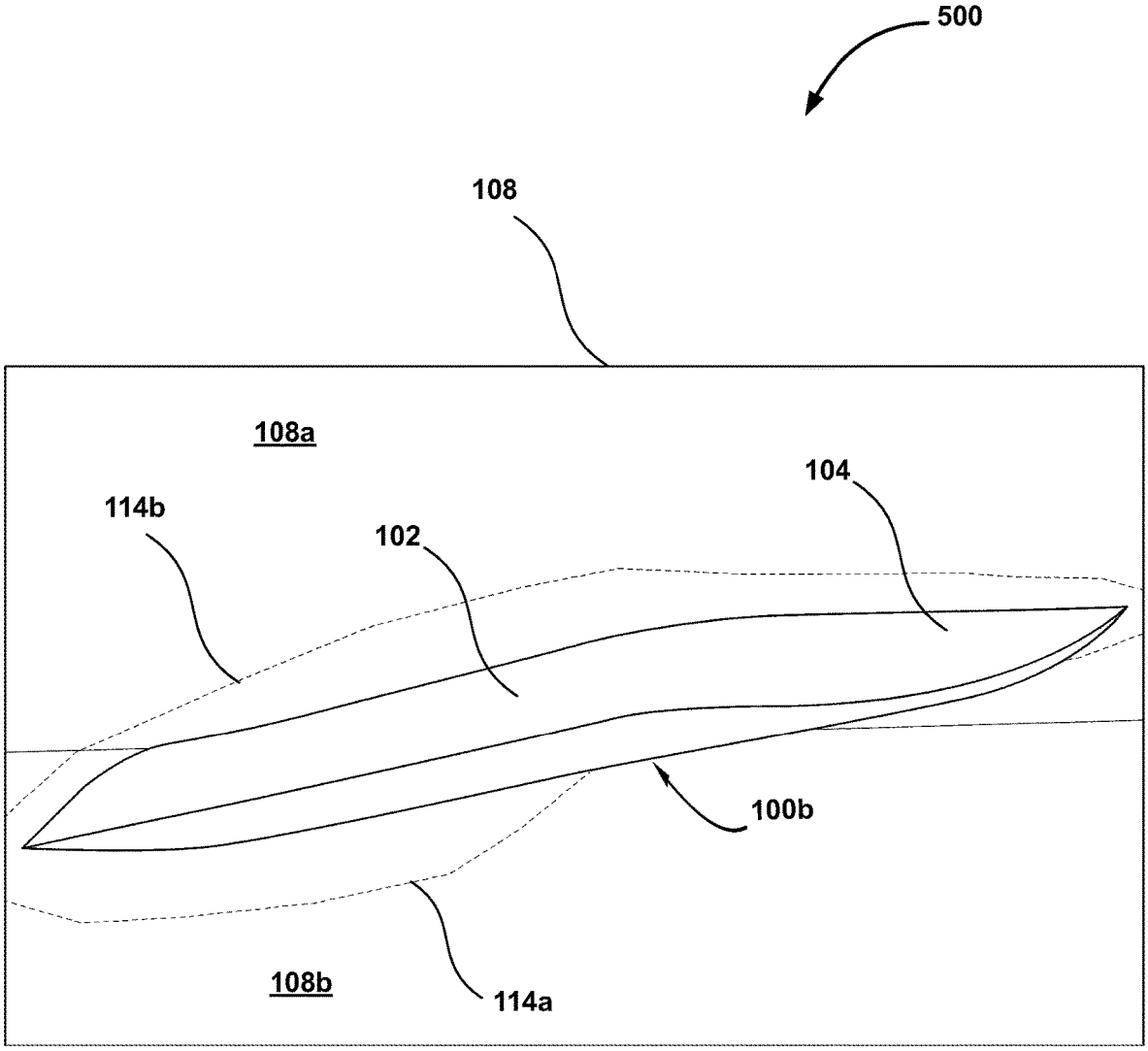
FIG. 5 is a diagram that illustrates the diverter attached to a keel and a bottom portion of the flat bottom boat, according to another exemplary embodiment of the present invention.

FIG. 5 is a diagram 500 that illustrates the diverter portion 100*b* attached to the keel 108*b* and the bottom surface 108*a* of the flat bottom boat 108, according to another exemplary embodiment of the present invention. In this embodiment, few portions of the diverter portion 100*b* are welded to the flat bottom surface 108*a*, and other portions of the diverter portion 100*b* are welded to the keel 108*b*. For example, few portions 114*a* of the front face (i.e., the first portion 102) are welded to one side of the keel 108*b* and remaining portions 114*b* of the front face (i.e., the first portion 102) and sloped front face (i.e., the second portion 104) are welded to the flat bottom surface 108*a* of the boat 108.

Techniques consistent with the disclosure provide, among other features, an apparatus for diverting operations by using the diverter device 100 for flat-bottom boats or ships. This device causes bubbles trapped at the hull surface to be shed sideways away from the propellers. While various exemplary embodiments of the disclosed system and apparatus have been described above, it should be understood that they have been presented for purposes of example only, and not limitations. It is not exhaustive and does not limit the disclosure to the precise form disclosed. Modifications and variations are possible in light of the above teachings or may be acquired from practicing of the disclosure, without departing from the breadth or scope.

While various embodiments of the disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims.

What is claimed is:

1. A diverter for a flat bottom boat comprising: a plurality of diverter portions including a left-side diverter portion (100*a*) and a right-side diverter portion (100*b*), wherein each diverter portion further comprises a first plate with an angled front face, the first plate is welded to a bottom surface of a hull forming an acute forward-leaning angle between the angled front face and the bottom surface of the hull, such that a forward facing diversion channel is formed in a volume between the bottom surface of the hull and the angled front face of the first plate, wherein said diverter portions and diversion channel are swept aft, such that, during the forward motion of the boat, substantially all water and contained debris that encounters said diversion channel is collected and diverted in an outboard direction.

2. The diverter of claim 1, wherein the diverter is formed of solid metal plate having substantially no holes or perforations.

3. The diverter of claim 2, wherein the diverter portions are swept aft at approximately a 45-degree angle.

4. The diverter of claim 3, wherein the forward-leaning angle of the first plate is approximately 45-degrees.

5. The diverter of claim 2, wherein the metal plate is steel and is continuously welded to the bottom surface of a steel boat.

6. The diverter of claim 2, wherein the metal plate is aluminum and is continuously welded to the bottom surface of an aluminum boat.

* * * * *